US008096144B2

(12) United States Patent
Castrén et al.

(10) Patent No.: US 8,096,144 B2
(45) Date of Patent: Jan. 17, 2012

(54) SUPPLY AIR TERMINAL UNIT

(75) Inventors: Markus Castrén, Lahti (FI); Risto Castrén, Lahti (FI)

(73) Assignee: Retermia Oy, Heinola (FI)

( * ) Notice: Subject to any disclaimer, the term of this patent is extended or adjusted under 35 U.S.C. 154(b) by 1010 days.

(21) Appl. No.: 12/030,015

(22) Filed: Feb. 12, 2008

(65) Prior Publication Data

US 2008/0196433 A1 Aug. 21, 2008

(30) Foreign Application Priority Data

Feb. 16, 2007 (FI) ..... 20075115

(51) Int. Cl.
*F25D 17/04* (2006.01)

(52) U.S. Cl. ..... 62/404

(58) Field of Classification Search ..... 62/259.1, 62/404; 55/504; 454/252
See application file for complete search history.

(56) References Cited

U.S. PATENT DOCUMENTS

| | | | | |
|---|---|---|---|---|
| 3,350,862 A | | 11/1967 | Nutting | |
| 3,740,934 A | * | 6/1973 | Shuler | 55/490 |
| 5,871,556 A | * | 2/1999 | Jeanseau et al. | 55/385.2 |
| 6,007,595 A | * | 12/1999 | Baik et al. | 55/385.2 |

FOREIGN PATENT DOCUMENTS

| | | |
|---|---|---|
| FI | 841042 A | 9/1985 |
| FI | 852641 A | 1/1987 |

OTHER PUBLICATIONS

"Hydrocell Lämmöntalteenotto", web page printout, http://www.hydrocell.fi/fi/lammonsiirtimet/lammontalteenotto.html Nov. 2005.
"Hydrocell Tuloilmapatteri", web page printout, http://www.hydrocell.fi/fi/lammonsiirtmet/tuloilmapatteri.html Aug. 2005.
"RETERMIA Kustannustehokkain energiansäästöratkaisu" web page printout, http://www.retermia.fi/fi/cfmldocs/index.cfm?ID=481 Feb. 2003.
"Hydrocell Referenssit", web page printout, http://www.hydrocell.fi/fi/lammonsiirtimet/referenssit.html Feb. 2003.
"Heat recovery systems" web page printout, http://www.hydrocell.fi/en/heat_exchange_devices/heat_recovery_systems.html downlowded from website Feb. 6, 2008.
"Heat exchange devices" web page printout, http://www.hydrocell.fi/en/heat_exchange_devices/index.html downloaded from website Feb. 6, 2008.
Search Report from Finnish Application No. 20075115.

* cited by examiner

*Primary Examiner* — Melvin Jones
(74) *Attorney, Agent, or Firm* — Stiennon & Stiennon

(57) ABSTRACT

A supply air terminal unit (10) has a body (11) with side walls, top and bottom walls and an opening cover, which is opened to allow access for service work inside the structure. A wall structure (12) formed by needle-fin tubes (100) is fitted around a central fine filter (13), whereby the needle-fin tubes (100) are placed on top of each other in order to form a filter wall (12). A needle-fin tube (120) has needle-like fins whereby in its tube a heat carrier is made to flow in order to transfer heat into the air made to flow through the structure or in the opposite direction. The fine filter (13) covers an air outlet port ($A_2$) located in the bottom (11$a_5$) of the supply air terminal unit.

11 Claims, 7 Drawing Sheets

SUPPLY AIR TERMINAL UNIT

CROSS REFERENCES TO RELATED APPLICATIONS

This application claims priority on Finnish App. No. 20075115, filed Feb. 16, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a supply air terminal unit.

Separate machine rooms in connection with supply air arrangements are known in the state of the art.

SUMMARY OF THE INVENTION

This application presents a supply air terminal unit solution of quite a new type, which is especially suitable for use as a supply air terminal unit for mounting on the roofs of buildings and which looking from the direction of airflow comprises a heat-transferring pre-filter wall, an air fine filter and possibly also a second heating step. According to the invention, the filter wall of the pre-filter is made of needle-fin tubes in the unit. The pre-filter is placed in the unit's interior space E as a peripheral structure, whereby air will arrive in space E from the sides.

As presented in this application, the needle-fin tube comprises a band wound around the tube proper and comprising in two rows needle-like fins, which are positioned at an angle in relation to one another. Said adjacent needle fins thus form an acute angle in relation to each other, in which angle impurity particles will depending on their size be caught in the filtration event. In the needle-fin tube proper, heat can be transferred through the fins from the air or the air can be heated in the opposite direction through the needle-fin tube.

According to the invention, the unit is formed by a box-like and preferably rectangular cross section or also in one embodiment of a circular cross section. As described above, as seen in the supply air flow $L_1$, the first component is at least one filtering wall 12 formed of needle-fin tubes. The wall in question is a peripheral structure positioned around a second filter 13. Inside the wall 12 formed by a needle-fin tube there is thus a fine filter 13, which is formed as a cassette-like modular unit, which when contaminated can be easily exchanged and/or cleaned. The air supplied through the supply air terminal unit 10 can be either cooled or heated and filtered with the aid of the needle-fin tube wall 12. In the direction of the airflow $L_1$, the equipment may after the pre-filter 12 also comprise a separate heating coil (not shown) in order to produce a final temperature for the airflow $L_1$.

The filters, pre-filter and fine filter or after-filter as well as a possible after-heater are fitted into the unit in this manner. Above the concerned structures there is an opening top cover, whereby the structures are easily accessible for service in order to clean/exchange/inspect them, whereby the serviceability of the unit is good.

It was realized in accordance with the invention to fit the after-filter or fine filter 13 to cover an outlet port $A_2$ located in the bottom of the supply air terminal unit. In accordance with the invention, in connection with the outlet port $A_2$ there is a latticework, on top of which the filter modules are piled to form a uniform fine filter. In connection with service work it is easy to exchange each module by opening the top cover of the supply air terminal unit. Service work according to the invention is easily done, because there is easy access to the filter modules from above. According to the invention, the filter modules are thus resting on the latticework, and each one of them is fastened by screws or other such clamps to lattice beams or other such. When the airflow is leaving the after-filter or fine filter modules $\mathbf{13}a_1$, $\mathbf{13}a_2$, the airflow has a direction $L_1'$, which is essentially perpendicular in relation to the direction of arrival of the air in the chamber E inside the unit.

The supply air terminal unit in question can be mounted either on a roof or also inside the building. For the supply air flow, the unit comprises an opening above and below and possibly a lattice therein. The opening is also formed as a circular flow gap.

The invention will be described in the following by referring to some advantageous embodiments of the invention, which are shown in the figures of the appended drawings, but there is no intention to restrict the invention to these embodiments alone.

DESCRIPTION OF THE PREFERRED EMBODIMENTS

Figure 1A:
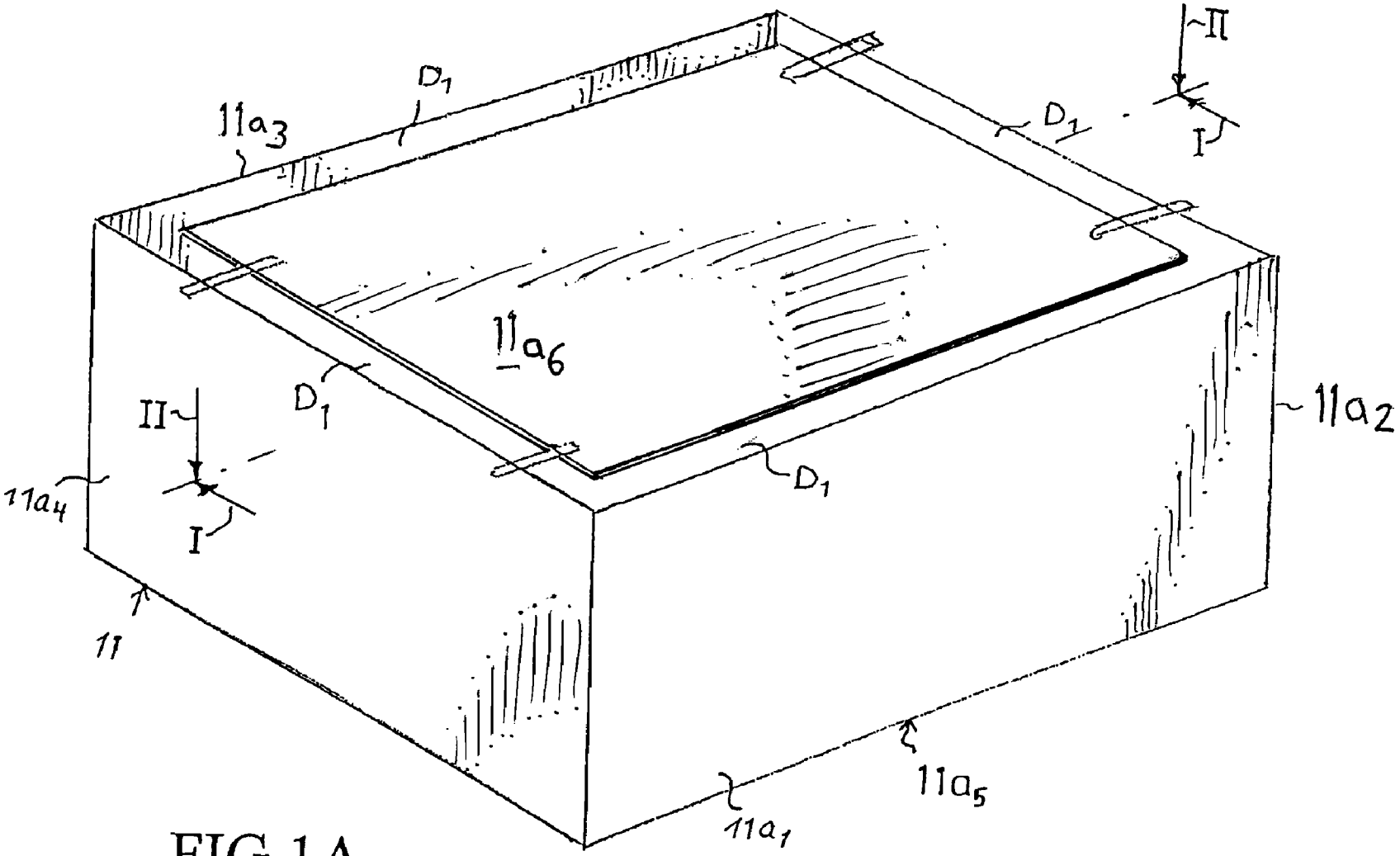
FIG. 1A is an axonometric view of the supply air terminal unit according to the invention.
Figure 1B:
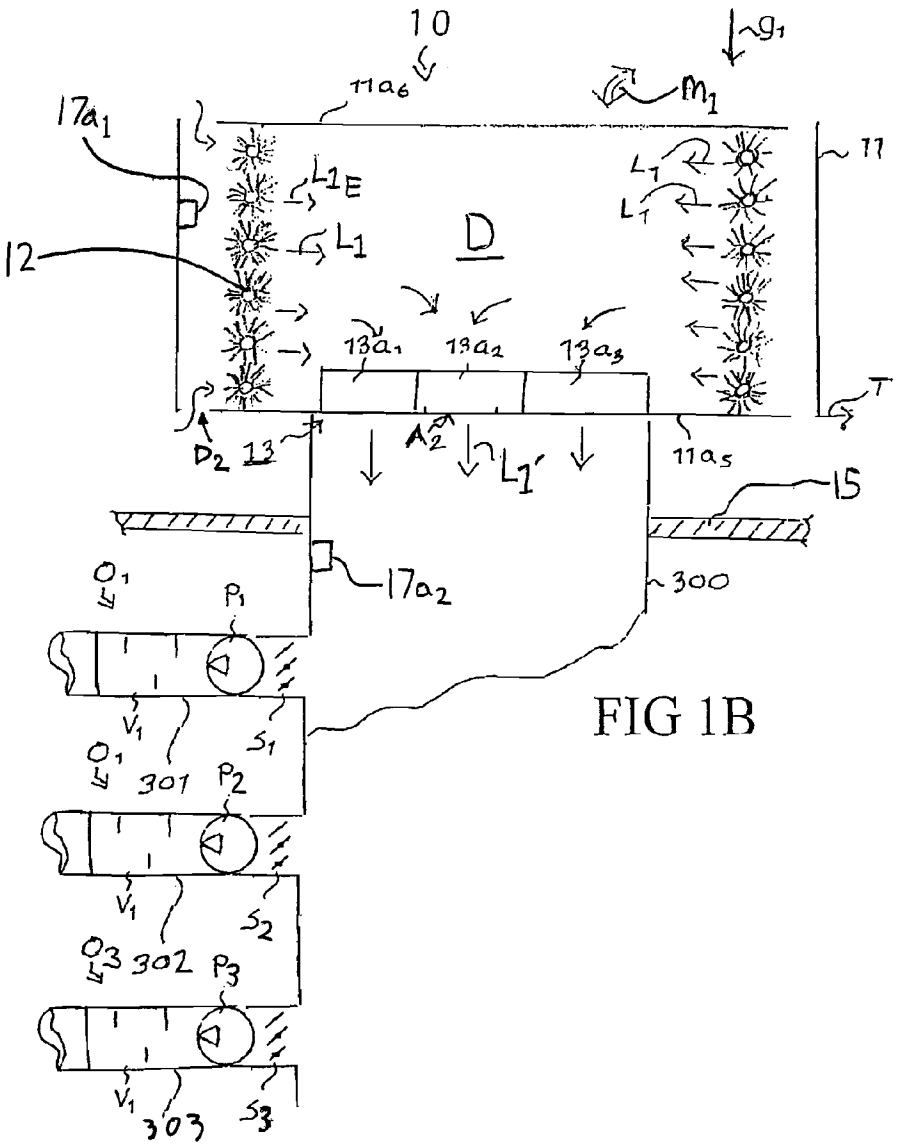
FIG. 1B is a cross-sectional view along line I-I of FIG. 1A.
Figure 1C:
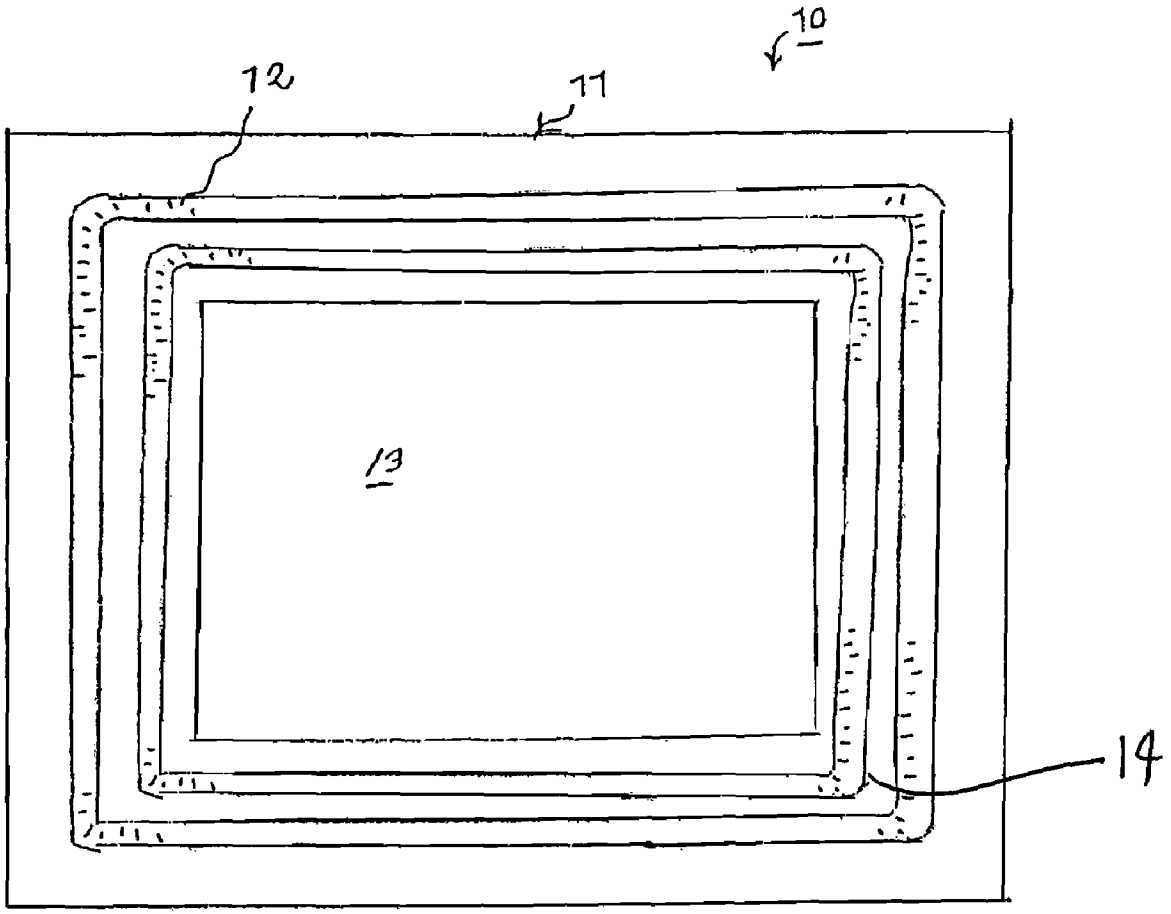
FIG. 1C is a cross-sectional view along line II-II of FIG. 1A.

FIGS. 1A, 1B and 1C show the supply air terminal unit 10 according to the invention. The supply air terminal unit 10 comprises a box structure 11, which comprises side walls $\mathbf{11}a_1$, $\mathbf{11}a_2$, $\mathbf{11}a_3$ and $\mathbf{11}a_4$ and a bottom wall $\mathbf{11}a_5$ as well as an opening top cover $\mathbf{11}a_6$. An airflow gap D1 and D2 is left on each side of the square structure in its upper and lower parts, whereby air can be made to flow as shown in FIG. 1B by arrows $L_1$ from outside into the space E inside the structure and from space E in the direction of arrow $L_1'$ and out through an outlet port $A_2$.

Figure 3E:
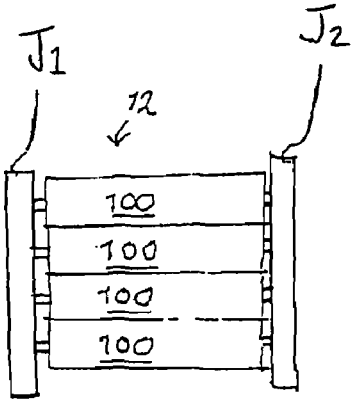
FIG. 3E shows a filter wall formed by needle-fin tubes in connection with inlet manifolds $J_1$ and $J_2$.
Figure 3A:
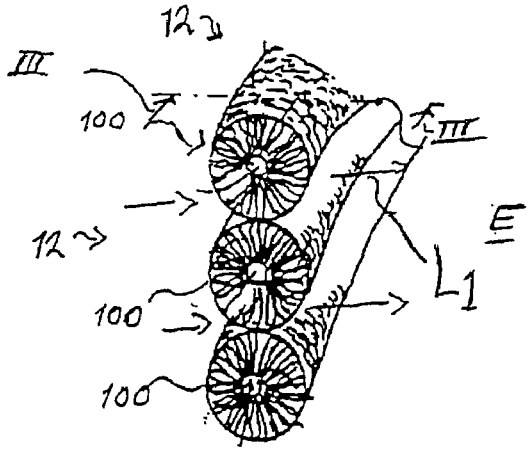
FIG. 3A shows the needle-fin tube according to the invention.
Figure 3B:
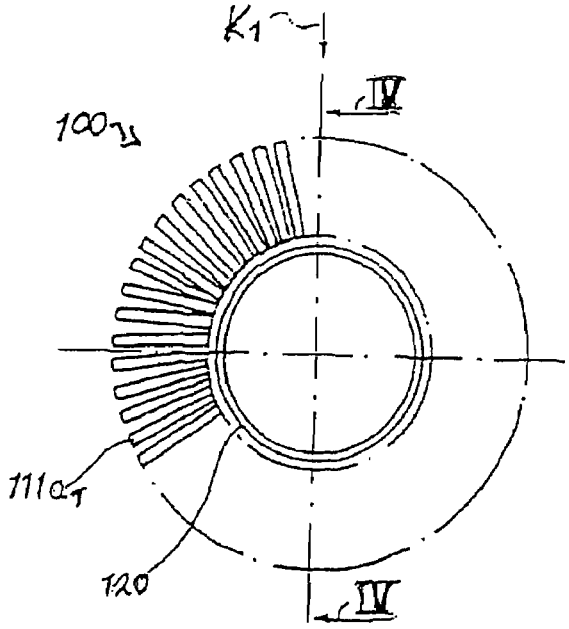
FIG. 3B is a cross-sectional view along line III-III of FIG. 3A.
Figure 3C:
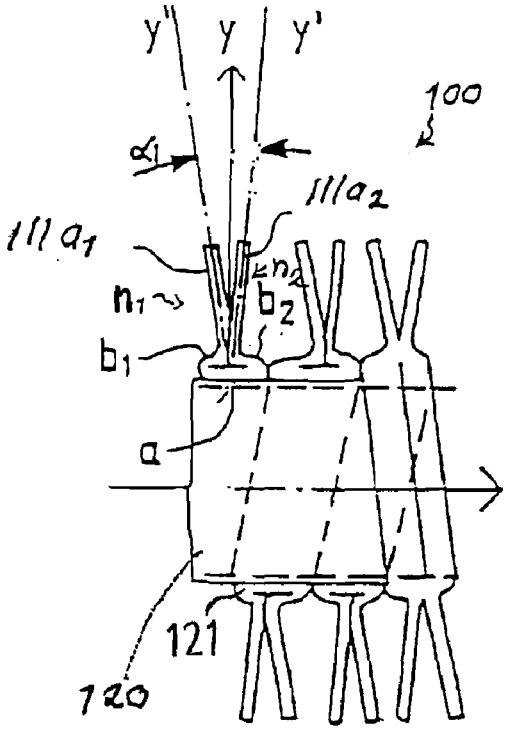
FIG. 3C shows the fin band of the needle-fin tube glued on to the tube as a cross-sectional view along line IV-IV of FIG. 3B.

As shown in the FIGS. 1A, 1B and 1C, and seen in the direction of the supply airflow $L_1$, the supply air terminal unit 10 comprises a first filter 12, which is a so-called pre-filter, which preferably is a coarse-mesh filter and formed by needle-fin tubes in accordance with the invention. The needle-fin tubes are placed on top of one another and they form a wall structure functioning as a filter and as a heat exchanger. (FIGS. 3A, 3B and 3C show the structure of a needle-fin tube). After the pre-filter 12 in the flowing direction of airflow $L_1$ a fine filter or after-filter 13 is located.

As shown in the figures, the pre-filter 12 is fitted around the after-filter 13 as a peripheral structure to surround it. By the above-mentioned location of the filters around duct 300 a large filtering cross-section is achieved and correspondingly a small pressure loss over the filters. The device 10 preferably comprises a pressure sensor 17$a_1$ in front of the filters 12, 13 and a pressure sensor 17$a_2$ after the filters 12, 13 in relation to the direction of flow $L_1$, whereby in the device solution any pressure difference will be detected between the sensors 17$a_1$, 17$a_2$ and thus the purity of the filters 12, 13 is indicated as well as their possible degree of clogging and need for exchange.

If the filters 12, 13 are clogged and they must be washed/exchanged, this is easily done in the structure according to the invention by opening the supply air terminal unit's top cover 11$a_6$, whereby there will be access to the filters 12, 13 in space E. Space E can be a service space. The pre-filter 12 can be washed by a jet of water under pressure, and the fine filter 13 can be exchanged or taken away for cleaning. The pre-filter's 12 filtration class is EU3 and the after-filter's or fine filter's 12 filtration class is EU7, EU8 or EU9 or even more efficient.

shown in FIGS. 1A, 1B and 1C, after the pre-filter 12 formed by needle-fin tubes 100 there is a fine filter or after-filter 13. The fine filter or after-filter 13 is located in connection with the outlet port in chamber E of the supply air terminal unit 10, that is, in connection with outlet port $A_2$ from space E in the bottom of chamber E. The fine filter 13 is arranged to cover the outlet port $A_2$ tightly. The fine filter 13 is advantageously formed modularly of filter units 13$a_1$, 13$a_2$, 13$a_3$ . . . , which may be, for example, filter items of a size of 60×60 cm, which are piled to cover the air outlet port $A_2$ on top of the latticework 200. A compact filter 13 is also possible. The latticework 200 may comprise elongated metal fins $f_1$, $f_2$ . . . , which extend through port $A_2$ and on top of which the filter modules 13$a_1$, 13$a_2$, 13$a_3$ . . . are piled to rest by gravity (the direction of the earth gravity field is indicated by an arrow $g_1$), as shown in FIG. 1B. The flow away from filter 13 along duct 300 is in the direction of arrow $L_1$', that is, in the direction of the earth's gravity field $g_1$ and essentially at right angles in relation to the flow $L_1$ taking place from pre-filter 12 into space E. To port $A_2$ a barrel or outlet duct 300 is connected, which branches off into a plurality of branch ducts 301, 302, 303, each one of which may comprise an air conditioner $O_1$, $O_2$, $O_3$ . . . comprising a damper $S_1$, $S_2$, $S_3$ after this a fan $P_1$ and a noise trap $V_1$. The outlet duct 300 is also a supply air duct into the building. However, no separate filter is needed in the concerned air conditioner, because the filter for the entire structure is formed by the supply air terminal unit 10 according to the invention with its pre-filter 12 and fine filter 13. Each air conditioner $O_1$, $O_2$, $O_3$ . . . located in one of the plurality of branch ducts 301, 302, 303 of the barrel or outlet duct 300 having a corresponding fan $P_1$, $P_2$, $P_3$ . . . and these fans can be operated independently of each other. The functioning ability of the system is guaranteed by the linear conductance of the pre-filter 12 used, which is formed by needle-fin tubes 100, as shown in FIG. 3E, which makes it possible for the heat exchange in regard to the pre-filter 12 to work both at low fan speeds and airflow rates and also at high fan speeds and airflow rates. The after-filter or fine filter 13 works perfectly at all times, because after the pre-filtration the air is clean and dry. This is guaranteed by the needle-fin tube structure used as the pre-filter structure.

Figure 1D:
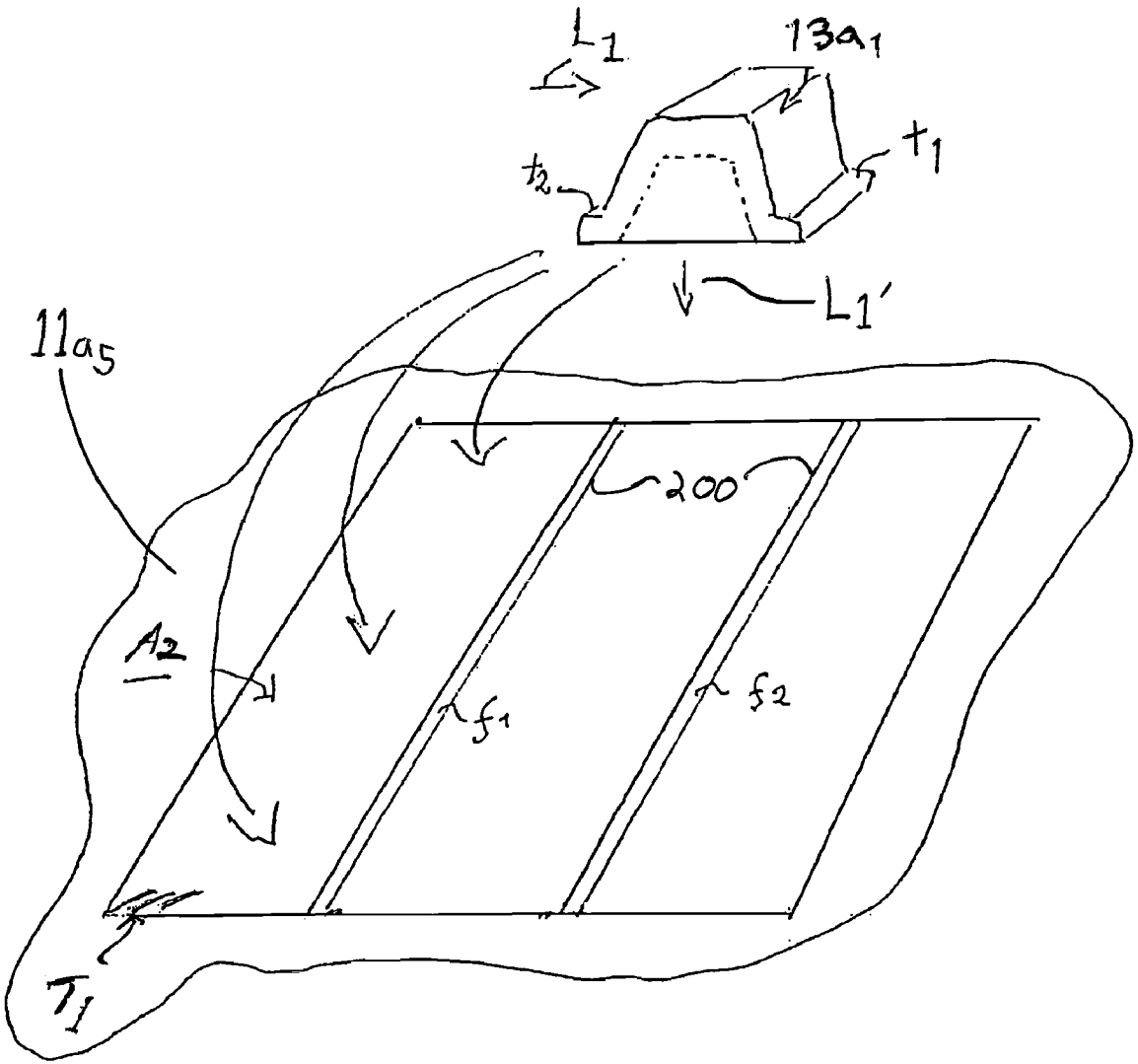
FIG. 1D is an illustrative view of a module $\mathbf{13}a_1$, $\mathbf{13}a_2$ . . . , which is placed in connection with a latticework.

The pre-filter 12 is formed by filter modules 13$a_1$, 13$a_2$, 13$a_3$ . . . , which are piled to cover the outlet port $A_2$. This makes easy serviceability of the structure possible, because the supply air terminal unit 10 comprises an opening cover 11$a_6$, which when opened allows easy access into the service space D and to the filter 13 and its modules 13$a_1$, 13$a_2$, 13$a_3$ . . . FIG. 1D illustrates the modular filter structure in connection with the outlet port $A_2$. The filter modules 13 are assembled on top of a lattice network $f_1$, $f_2$ . . . covering the outlet port $A_2$ and attached tightly to the lattices, for example, by screws. No bypassing leakage can occur. When the filter 13 is exchanged, the attachment is opened and the filter modules 13$a_1$, 13$a_2$, 13$a_3$ are removed from the structure by opening the top cover 11$a_6$ in the manner shown by arrow $M_1$ in FIG. 1B. Top cover 11$a_6$ can be turned carried by hinges to an opened and closed position or it can be put aside when opening it. The modules 13$a_1$, 13$a_2$ . . . rest under their own weight (the direction of the gravity field is indicated by $g_1$) on top of lattices $f_1$, $f_2$ . . . and they are attached to the lattices $f_1$, $f_2$ . . . in a removable manner.

FIG. 1D illustrates a module, the size of which can be 60×60 cm. Always depending on the air volume of the supply air terminal unit, it is possible to choose the size of the supply air terminal unit's 10 opening $A_2$ and thus the size of the lattice network $f_1$, $f_2$ . . . and the modular after-filter 13 covering the same.

In the supply air terminal unit 10 according to the invention, the direction of flow $L_1$ of the airflow from pre-filter 12 into chamber D is essentially at right angles in relation to the direction of discharge $L_1$' of the airflow from port $A_2$ into the exit duct and into the supply air duct 300 of the building. Under these circumstances, airflow $L_1$ changes its travelling direction by about 90° when leaving chamber D for the exit duct 300. Filter modules 13$a_1$, 13$a_2$ . . . may be such structures, that they have several filter layers. The filter may be, for example, a conical structure, thus comprising an air space inside the cone. A supply air terminal unit 10 which is to be placed on a roof 15 may thus serve several supply air terminal devices $O_1$, $O_2$, $O_3$ . . .

The supply air terminal unit 10 may be provided with pre-heating (heat recovery), cooling, pre-filtering (needle-fin battery) 12 and main filtration of the supply air and possibly also with an after-heating function (by needle battery 14) of the supply air. The plane of port $A_2$ is indicated by $T_1$ in FIG. 1D. The filter 13 forms a plate-like structure located in a horizontal direction. The filter structure may be formed by a serrated profile in cross-section. The after-heating unit may be located in space E after the pre-filter 12 and it too may be formed by a wall formed by needle-fin tubes 100. It may also be located peripherally around the fine-filtration unit 13.

The supply air terminal unit 10 can be dimensioned for a smaller airflow than the totalled design airflow of the fans $P_1$, $P_2$, $P_3$, . . . of each of the plurality of exit ducts 301, 302, 303 of the supply air terminal devices serving the supply air terminal unit. This is due to the fact that the serving supply air fans $P_1$, $P_2$, $P_3$, . . . of the plurality of exit ducts 301, 302, 303 of the supply air terminal unit 10 will not probably ever be working all at the same time at full airflow. Calculated by a simultaneity coefficient of 0.7, the supply air terminal unit 10 can be dimensioned for an airflow which is smaller by 30% in comparison with state-of-the-art heat recovery, cooling and filtration solutions for specific devices.

Figure 2:
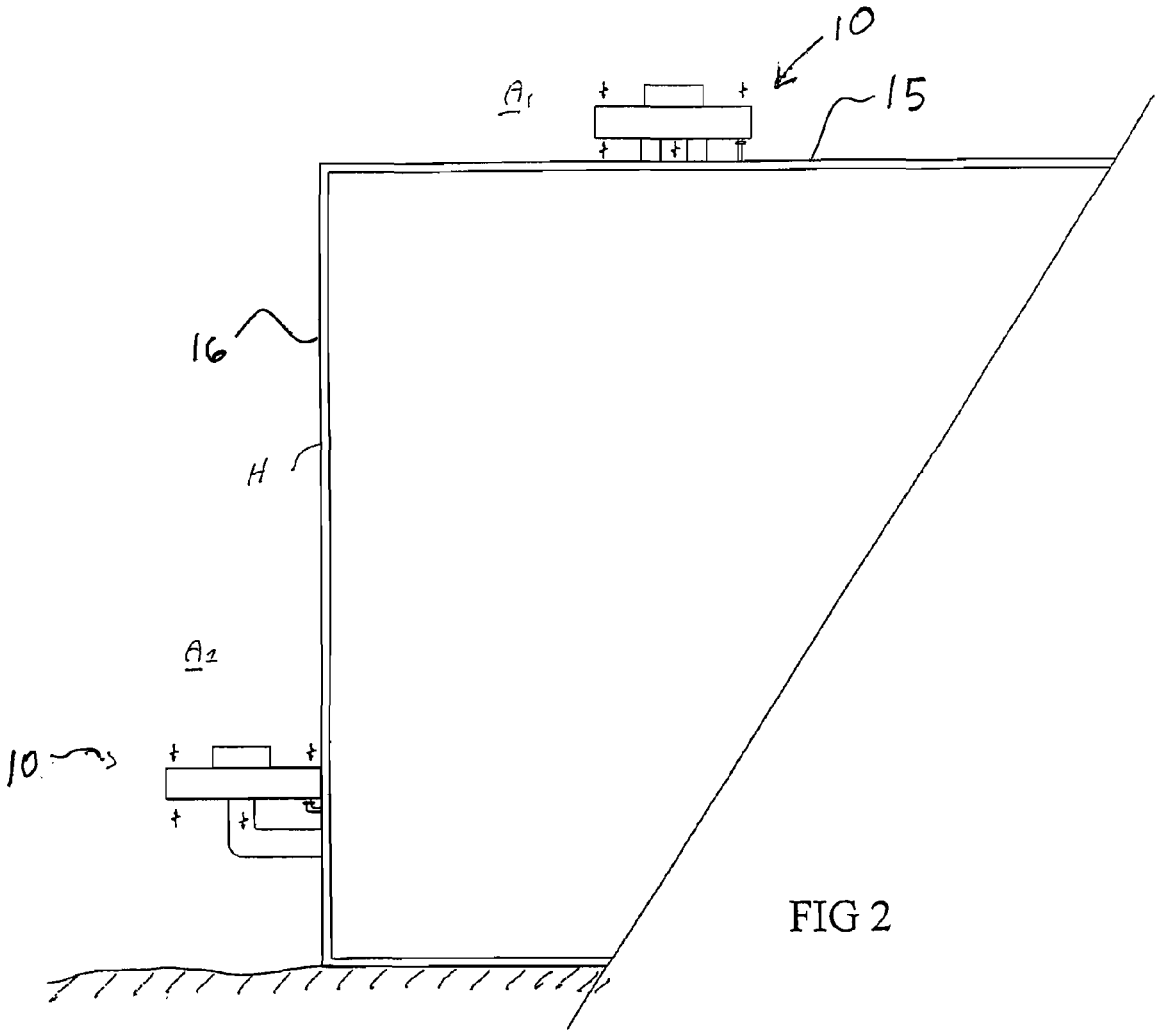
FIG. 2 shows how the supply air terminal unit is placed on a roof and on a wall in a building.

FIG. 2 shows how the supply air terminal unit 10 is located in position $A_1$, that is, on the roof 15 of a building H, and the figure also shows another position $A_2$, in which the supply air terminal unit is fitted on a wall 16 of the building H.

Figure 3D:
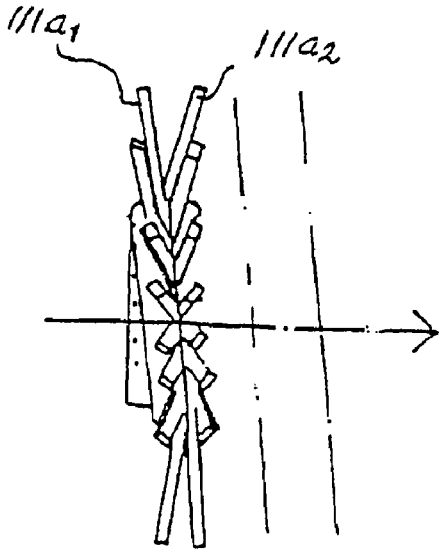
FIG. 3D shows the structure in the direction of arrow $K_1$ in FIG. 3B.

FIG. 3A shows a needle-fin tube 100 according to the invention. FIG. 3B is a cross-sectional view along line III-III of FIG. 3A, and FIG. 3C is a cross-sectional view of a fin band along line IV-IV of FIG. 3B. FIG. 3D shows the structure in the direction of arrow $K_1$ of FIG. 3B. As shown in FIGS. 3A, 3B, 3C and 3D, the needle-fin tube solution 100 comprises a central tube 120, to which the fin band 121 is joined by winding it and attaching it around the tube 120.

As shown in FIG. 3C, the needle-fin band 121 has two adjacent needle rows $n_1$ and $n_2$, whose opposite needle fins 111$a_1$, 111$a_2$ are at an acute angle $\alpha_1$ in relation to each other. Said angle $\alpha_1$ is an acute angle, whereby impurity particles will be caught at various height positions in between adjacent fins 111$a_1$, 111$a_2$. The needle-fin tube 100 functions both as a filter and as a heat exchanger. Heat can be transferred through it from a heat carrier made to flow inside tube 120 through the needle fins 111$a_1$, 111$a_2$ . . . into the air or heat can be transferred in the opposite direction from the air from the flow $L_1$ through the needle fins 111$a_1$, 111$a_2$ . . . into the heat carrier made to flow centrally in tube 120, whereby the airflow $L_1$ will be cooled. Both purposes of use are possible. The fin band 121 comprises a base part a and folded covering parts $b_1$ and $b_2$, to which the needle fins 111$a_1$, 111$a_2$ . . . are joined. Thus, the needle-fin tube 100 can be used in the manner shown in FIG. 3E. The needle-fin tubes 100 are formed as a filter wall 12, whereby a heat carrier is conducted from the distributing manifold $J_1$ into each needle-fin tube 120 on the wall 12, and the heat carrier is removed from distributing manifold $J_2$. Wall 12 forms the pre-filter's so-called coarse-mesh filter and a heat exchanger, after which the equipment comprises a fine filter 13, with which impurity particles of a smaller particle size can be removed from the air after the pre-filtration.

We claim:

1. A supply air terminal unit comprising:

a body having side walls, a top wall, a bottom wall, and an interior space, and portions of the side walls forming inlet ports which allow air to flow in to the interior space;

an opening cover mounted to the body which is openable to allow access for service work into the interior space;

an air outlet port located in the body bottom wall;

a central fine filter mounted to cover the outlet port;

a pre-filter wall formed by a plurality of needle-fin tubes, wherein the needle-fin tubes are placed on top of each other to form a filter wall and wherein each needle-fin tube has needle fins around a central tube, the pre-filter wall positioned in the interior space of the body, and surrounding the central fine filter so that air entering the inlet ports first passes through the pre-filter wall then through the central fine filter then through the outlet port; and wherein the central tube of each needle-fin tube is connected to a source of fluid heat carrier.

2. The supply air terminal of claim 1, wherein the fine filter is formed by modular filter units.

3. The supply air terminal of claim 1, wherein the fine filter is held to rest on top of the outlet port by gravity.

4. The supply air terminal of claim 2, wherein the modular filter units have edges, and wherein the outlet port is provided with a structure to which the modular filter units of the fine filter are attached at their edges.

5. The supply air terminal of claim 4 wherein the structure is formed by a latticework which forms a network on top of the outlet port.

6. The supply air terminal of claim 1, wherein the outlet port is connected to a duct which branches off into a plurality of branch ducts, of which at least one comprises an air conditioner which has a fan, but no filter.

7. The supply air terminal of claim 1, wherein each needle-fin tube of the pre-filter comprises a band wound around the central tube and comprises at least two rows of needle fins where opposite fins are located at an acute angle in relation to each other, so that impurity particles can be caught in a space between said opposite fins.

8. The supply air terminal of claim 1 further comprising an air after-heating unit in the interior space.

9. The supply air terminal of claim 1, wherein the supply air terminal is arranged so that air flows from the pre-filter into the interior space along a direction which is essentially at right angles to a direction defined by airflow through the outlet port.

10. A supply air terminal unit comprising:

a body having side walls, a top wall, and a bottom wall and an interior space, and portions of the side walls forming inlet ports which allow air to flow in to the interior space;

an opening cover mounted to the body which is openable to allow access for service work into the interior space;

an air outlet port located in the bottom wall of the body;

a central fine filter mounted to cover the outlet port;

a pre-filter wall formed by a plurality of needle-fin tubes, wherein the needle-fin tubes are placed on top of each other to form a filter wall and wherein each needle-fin tube has needle fins around a central tube, the wall structure positioned in the interior space of the body, and surrounding the central fine filter so that air entering the inlet ports first passes through the pre-filter wall then through the central fine filter then through the outlet port;

wherein the central tube of each needle-fin tube is connected to a source of fluid heat carrier; and a duct connected to the outlet port and which branches off into a plurality of branch ducts, each of which has a fan, but no filter, and wherein the supply air terminal unit is selected to supply 70% of the air supplied by all of the plurality of branch ducts.

11. A method of arranging an air conditioner, comprising the steps of:

placing a supply air terminal unit on the exterior of a building;

drawing air into a body of the supply air terminal unit and passing the air through a pre-filter wall formed by a plurality of needle-fin tubes, wherein the needle-fin tubes are placed on top of each other to form a filter wall structure and wherein each needle-fin tube has needle fins around a central tube, the wall structure positioned in the interior space of the body, and surrounding a central fine filter so that air entering the inlet ports first passes through the wall then through the fine filter, then through to a duct which branches off into a plurality of branch ducts, each of which has a fan, of a selected full airflow but no filter, and wherein the supply air terminal unit is used to supply up to 70% of an air supply constituted by the sum of all of the selected full airflow of each of the fans of the plurality of branch ducts.

* * * * *